United States Patent [19]

Dawson

[11] 4,143,919

[45] Mar. 13, 1979

[54] MINING MACHINERY WITH GUIDEWAY FOR RELATIVELY MOVABLE CUTTING UNITS

[75] Inventor: Gordon B. Dawson, Hulland Ward, England

[73] Assignee: Atlow Mining Development Consultants Limited, Derbyshire, England

[21] Appl. No.: 839,177

[22] Filed: Oct. 4, 1977

[30] Foreign Application Priority Data

Oct. 9, 1976 [GB] United Kingdom ..... 42082/76
Jul. 7, 1977 [GB] United Kingdom ..... 28521/77

[51] Int. Cl.[2] ..... E21C 27/24

[52] U.S. Cl. ..... 299/59; 175/91; 299/71; 299/80

[58] Field of Search ..... 299/18, 57, 59, 71, 299/80; 175/62, 91, 401

[56] References Cited

U.S. PATENT DOCUMENTS

| | | | |
|---|---|---|---|
| 2,862,700 | 12/1958 | Gonski | 299/57 |
| 2,868,526 | 1/1959 | Jamison et al. | 299/59 |
| 3,245,723 | 4/1966 | Gonski | 299/57 X |
| 3,771,611 | 11/1973 | Omura et al. | 175/401 X |

*Primary Examiner*—Ernest R. Purser
*Attorney, Agent, or Firm*—Diller, Ramik & Wight

[57] ABSTRACT

A mining machine comprises two cutting units each including a rotatable cutting head having cutting faces directed forwardly and rearwardly with respect to the direction of movement of the machine, and an elongated housing incorporating a drive mechanism for the cutting head extending along the axis of rotation of the cutting head, the cutting units being mounted side-by-side with the cutting heads adjacent each other, each housing being movable about a vertical axis towards the end of the housing remote from the cutting head and about a transverse horizontal axis between the vertical axis and the cutting head, means for moving the cutting units about the said axes, the housings of the two cutting units being mounted on a common horizontal slideway, and the slideway defining the transfer horizontal axis about which the cutting units may be pivoted.

10 Claims, 8 Drawing Figures

MINING MACHINERY WITH GUIDEWAY FOR RELATIVELY MOVABLE CUTTING UNITS

This invention relates to mining machines.

In one known mining technique suitable for excavating stratified mineral deposits such as coal, a roadway, i.e., a tunnel large enough to carry men and machinery, is driven through a seam of the mineral and the surrounding strata. Material is then excavated from the seam adjacent the roadway using a remotely-controlled mining machine which comprises a plurality of cutting heads mounted on a frame. The machine is driven into the seam at right angles to the roadway by means of a chain of rigidly connected push rods operated by a pushing mechanism mounted in the roadway. The machine is then withdrawn from the driveway, the mouth of driveway is closed and a further driveway is then excavated adjacent and parallel to the first. This process is then repeated at regular intervals along the length of the roadway.

Hitherto, it has been considered necessary to fix the positions of the cutting heads on such mining machines and to select the size of the cutting heads so that the driveway excavated by the machine is self-supporting, thus obviating the need to shore the roof of the driveway as the machine is advanced along the driveway.

Broadly in accordance with the present invention there is provided a mining machine suitable for operation by remote control comprising two adjacent cutting heads having forwardly- and rearwardly directed cutting faces and mounted for movement away from each other transversely to the direction of movement of the machine. With this arrangement of cutting heads, the cross-sectional area of a driveway excavated as the machine is advanced into a seam can be widened when the machine is withdrawn from the driveway. As the machine is advanced, the cutting heads are operated at their closest transverse spacing so that the roof of the driveway is self-supporting. As the machine is withdrawn from the driveway however, the spacing between the cutting heads can be increased. Thus, the machine excavates not only whilst it is advanced into a driveway but also as it is withdrawn, and any roof falls which occur during withdrawal of the machine are confined to the parts of the driveway which have been fully worked.

More specifically, the invention provides a mining machine comprising two cutting units each comprising a rotatable cutting head having cutting faces directed forwardly and rearwardly with respect to the direction of movement of the machine and an elongated housing incorporating a drive mechanism for the cutting head extending along the axis of rotation of the cutting head, the cutting units being mounted side-by-side with the cutting heads adjacent each other, each housing being movable about a vertical axis towards the end of the housing remote from the cutting head and about a transverse horizontal axis between the vertical axis and the cutting head, and means for moving the cutting units about the said axes.

Usually, each cutting head will be of a diameter equal to or greater than the vertical height of the remainder of the machine so that the machine can advance directly into the aperture excavated by the cutting heads.

Preferably the housings are mounted on a common horizontal slideway which also defines the transverse horizontal axis about which the housings may be pivoted. The movement of the housing along the slideway may be achieved by any suitable drive mechanism, for example hydraulic cylinders. In one convenient construction, the slideway comprises a tube coaxial with the said horizontal axis, the means for moving the housings about the respective vertical axis comprising two pistons reciprocable under hydraulic pressure within a cylinder defined in the tube, each piston being connected to a respective one of the housings. A suitable connection between each piston and housing comprises a sleeve slidable on the cylindrical tube and movable along the tube by the piston.

The tube may define two separate cylinders for the pistons. Preferably however the tube defines a chamber within which both pistons are reciprocable so that pressure can be applied simultaneously to both pistons by introducing hydraulic fluid into the chamber between the pistons.

In general the slideway is located beneath the housings. With this arrangement the means for moving the cutting units about the vertical axes further comprises an hydraulic piston and cylinder mounted above the housings so that no torque is applied to the housings during movement along the slideway.

The machine preferably further includes upper and lower cusp cutters for removing the cusps of material which are left uncut between the two cutting heads. Preferably the lower cusp cutter is in the form of a mat of cutting chains entrained about a transverse horizontal axis. The lower cusp cutter may also include cutting drums mounted on opposite sides of the mat of cutting chains and arranged to rotate about the transverse horizontal axis.

The movement of the cutting units about the transverse axis is preferably controlled by hydraulic piston-and-cylinder arrangements. Desirably, the housings are connected together for simultaneous movement about the horizontal axes.

A preferred mining machine in accordance with the invention will now be described, by way of example only, with reference to the accompanying drawings in which.

Figure 1:
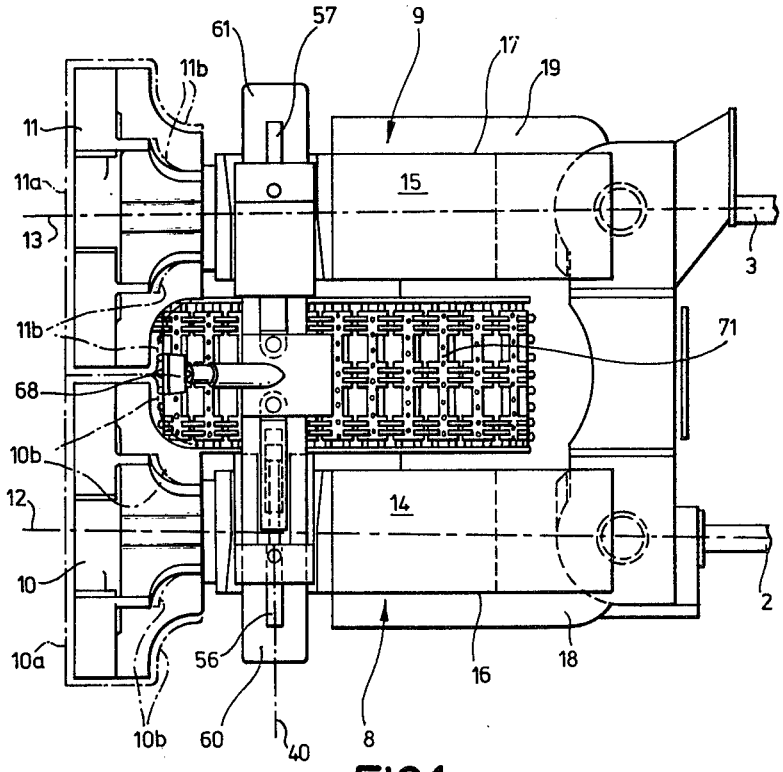
FIG. 1 is a plan of the machine with its cutting heads in a closed position.

Referring to the drawings, the mining machine comprises a skid frame 1 which is connected at its rear end to two lines of push rods 2, 3 which are operated by an hydraulic pushing mechanism (not shown) to advance and retract the machine towards and away from a working face 4 of a driveway 5. Two cutting units, indicated generally at 8 and 9, are mounted on the machine. Each cutting unit 8, 9 comprises a cutting head 10, 11 which is rotatable about a generally horizontal axis 12, 13, and an elongated housing 14, 15, which extends along the axis of rotation 12, 13 of the cutting head 10, 11. The diameters of the cutting heads are greater than the vertical height of the remainder of the machine. Each cutting head carries two arrays of cutting tools, (indicated by broken lines), one array of cutting tools 10*a*, 11*a* on its forwardly directed face, the other array of cutting tools 10*b* to 11*b* on its rearwardly directed face.

Each of the housings 14, 15 incorporates a drive mechanism for the cutting head 10, 11 each drive mechanism being composed of a conventional motor 16, 17 and transmission. Ventilation ducts 18, 19 are mounted on each housing 14, 15.

The two cutting units are mounted side by side on the mining machine with the two cutting heads adjacent each other and the axes of rotation 12, 13 of the cutting heads generally parallel and horizontal.

Figure 6:
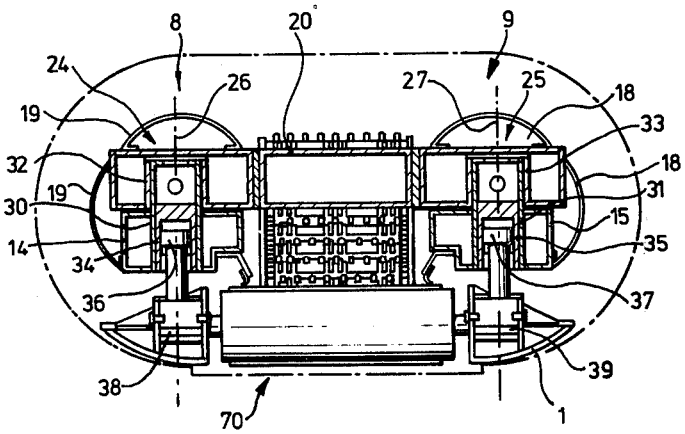
FIG. 6 is a vertical transverse cross section of the machine taken along line B—B of FIG. 3.
Figure 7:
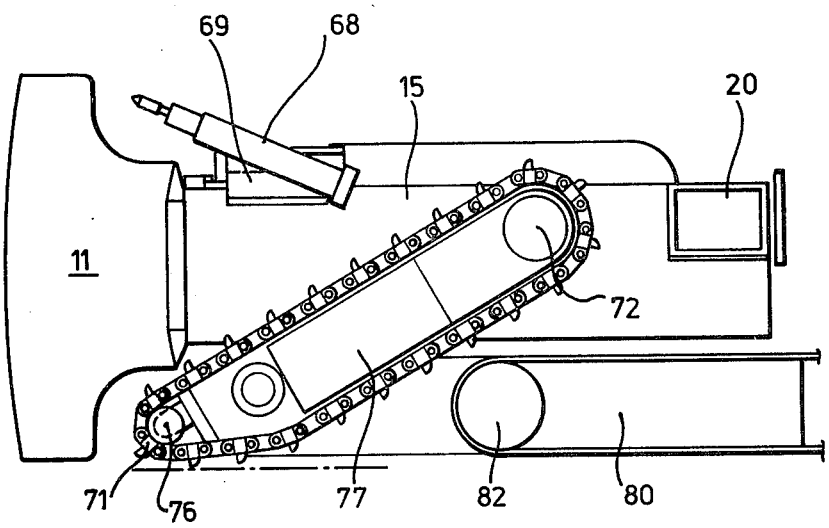
FIG. 7 is a vertical longitudinal cross section of the machine taken along the line A—A of FIG. 1.
Figure 8:
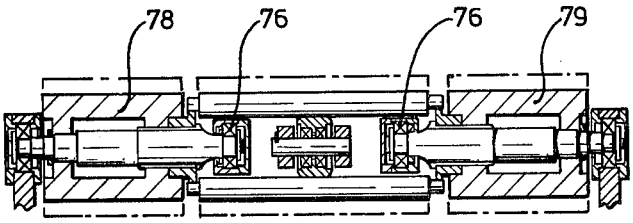
FIG. 8 is a transverse vertical cross section of part of a cusp cutter mounted on the machine of FIGS. 1 to 6.

As best seen in FIG. 6, each of the housings 14, 15 is pivotally connected towards its rear end to a box girder 20 mounted on the skid frame 1 of the machine. Each pivotal connection 24, 25 allows movement of the cutting unit 8, 9 about a vertical axis 26, 27. The pivotal connections 24, 25 each comprise a hollow cylinder 30, 31 fixed at its lower end to the housing 14, 15 and rotatably mounted at its upper end in a bearing 32, 33 in the box girder 20. The lower end of each cylinder 30, 31 accommodates an hydraulic cylinder 34, 35 within which a piston 36, 37 is reciprocable along the vertical pivot axis 26, 27. The lower end of each piston 36, 37 is secured to the skid frame 1 of the machine. The spacing between the rear ends of the housings 14, 15 and the skid frame may be adjusted by means of removable packers 38, 39 positioned between the pistons 36, 37 and the skid frame 1.

Figure 5:
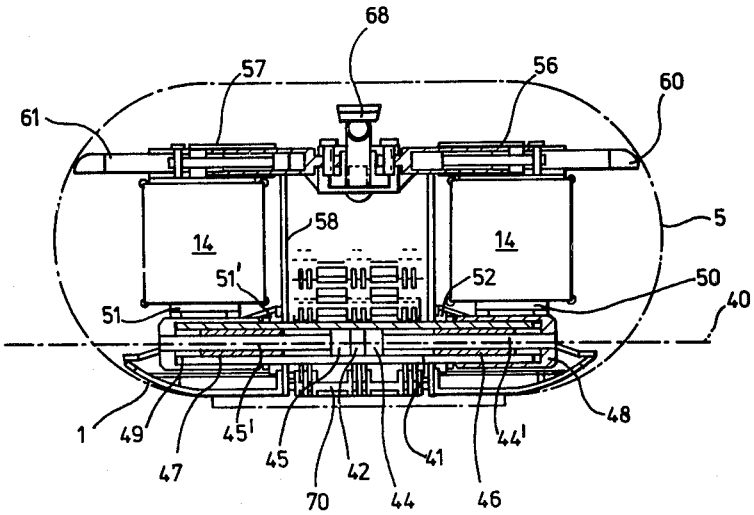
FIG. 5 is a transverse vertical cross section through the machine taken along line C—C of FIG. 3.

The cutting units 8, 9 are also mounted for pivotal movement about a transverse horizontal axis 40 which is positioned between the vertical axes 26, 27 and the cutting heads 10, 11. As best seen in FIG. 5, the horizontal axis 40 is defined by a cylindrical tube 41 which is fixed to the skid frame 1. The tube 41 is hollow and thus defines a cylindrical chamber 42 within which two pistons 44, 45 are reciprocable under hydraulic pressure. The movement of the two pistons 44, 45 within the tube 41 is limited by two spacers 46, 47 fixed within the tube 41. Each piston 44, 45 is connected by a piston rod 44', 45' to a respective sleeve 48, 49 which is slidable along the external surface of the tube 41 and is rotatable relative thereto around the horizontal axis 40. Each of the sleeves 48, 49 is in turn connected to the lower surface of a respective one of the housings 14, 15 of the cutting units 8, 9 by means of a slewing ring 50, 51 which accommodates relative movement of the sleeves 48, 49 and the associated housing 14, 15 about vertical axes. The movement of the sleeves 48, 49 towards the centre of the machine is limited by removable packers 51, 52 mounted on the tube 41.

The upper surfaces of each of the housings 14, 15 are attached to respective hydraulic piston and cylinder devices 56, 57 the opposite ends of each of which are secured to a box frame 58 mounted centrally on the skid frame 1 and extending upwardly between the two cutting units 8, 9. The outboard ends of each of the piston and cylinder devices 56, 57 carry respective arms 60, 61 which extend outwardly from the cutting unit 14, 15 to contact the wall of the driveway 5 excavated by the cutting heads 10, 11.

An upper cusp cutter in the form of an hydraulic breaker 68 is mounted on the upper surface of the box frame 58 and is positioned to remove uncut material from the roof of the driveway 5 between the two cutting heads 10, 11. If desired, the hydraulic breaker may be replaced by a mechanical cutter for example a static cutting blade and/or a cutting wheel mounted on the box frame 58 for rotation about an axis transverse to the direction of movement of the machine. A methanometer 69 is mounted on the box frame 58 beneath the hydraulic breaker 68.

A lower cusp cutter 70 is mounted on the skid frame 1 beneath the box frame 58 in order to excavate uncut material from the floor of the driveway 5 between the two cutting heads 10, 11. The lower cutter 70 comprises a mat of cutting chains 71 entrained about a set of co-axial drive sprockets 72 carried by the box frame 58 between the two cutting units and a set of co-axial idler sprockets 76 carried by the skid frame 1 immediately to the rear of the lower extremities of the cutting heads 10, 11. The drive sprockets 72 are driven by a motor and a double planetary bevel gearbox 77 positioned within the path of travel of the mat of cutting chain 71. Two cutting drums 78, 79 are mounted on opposite sides of the mat of cutting chains coaxially with the idler sprockets.

A conveyor belt 80 is entrained around a drive roller 82 mounted in the skid frame 1 immediately beneath the rear end of the mat of cutting chains to receive material conveyed rearwardly by the mat of cutting chains.

In use, the mining machine is advanced into the driveway 5 by means of the push rods 2, 3, the axes 12, 13 of the two cutting units being parallel, as shown in FIG. 1. Material excavated by the cutting heads 10, 11 and the upper and lower cusp cutters is conveyed rearwardly by the mat of cutting chains 71 onto the conveyor belt 80 which carries the material out of the driveway 5. Since the diameters of the cutting heads 10, 11 are larger than the vertical height of the remainder of the machine, the aperture excavated by the cutters is sufficiently large to accomodate the whole machine. Movement of the cutting heads 10, 11 during forward movement of the machine is not therefore necessary.

If it is desired to steer the machine in a horizontal plane to the right or left, the cutting units are pivoted about the vertical axes 24, 25 in the same direction thus maintaining the parallel alignment of housings 14, 15. For a left turn, fluid is introduced into the piston rod end of the piston-and-cylinder device 57 and into the piston end of piston-and-cylinder device 56. At the same time, hydraulic fluid is introduced into that part of the chamber 42 within the cylindrical tube 41 between the piston 45 and spacer 49 and is evacuated from the part of the chamber 42 between the piston 44 and the spacer 48. As a result, the cutting units 8, 9 are moved to the left in unison with no net torque being applied to either of the cutting units in the vertical plane. A turn to the right is effected by introducing hydraulic fluid into the piston end of the device 57, the piston rod end of the device 56 and into the part of the chamber 42 within the cylindrical tube 41 between the piston 44 and the spacer 48, the part between the piston 45 and the spacer 49 being exhausted.

If it is desired to direct the machine upwardly or downwardly, hydraulic fluid is either introduced into or removed from the piston cylinders 34, 35 simultaneously so that the two cutting units 8, 9 are pivoted about the horizontal axis 40.

Figure 2:
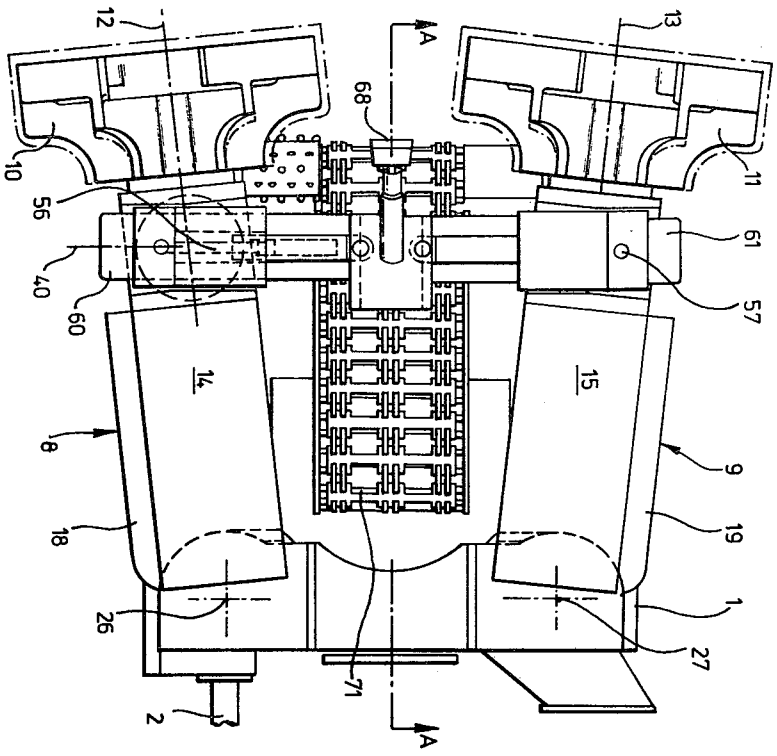
FIG. 2 is a plane of the machine with its cutting heads in an open position.
Figure 3:
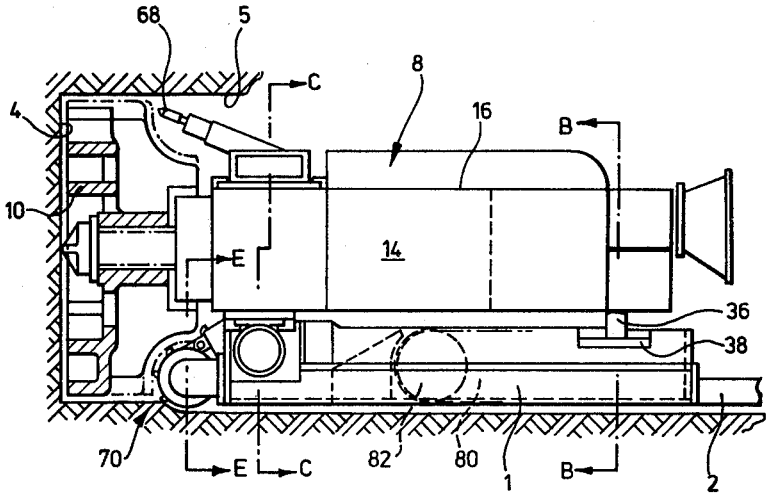
FIG. 3 is a side elevation of the machine.
Figure 4:
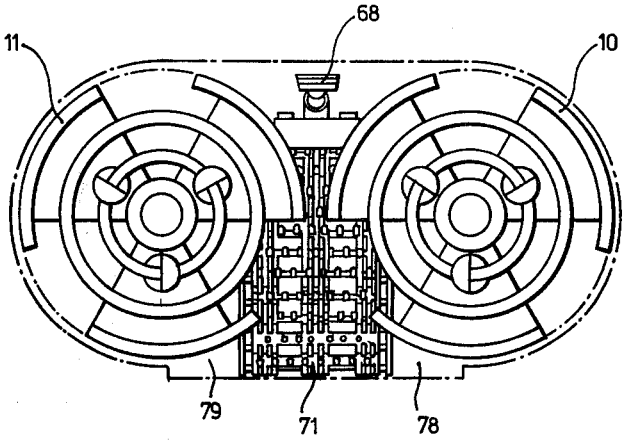
FIG. 4 is a front elevation of the machine.

When the machine has been advanced to the desired extent into the driveway, the machine is withdrawn by means of the push rod 2, 3. During the withdrawal, the cutting units 8, 9 are pivoted in opposite directions about the vertical axes 25, 26 by introducing hydraulic fluid into that part of the chamber 42 within the cylindrical tube 41 between the two pistons 44, 45. At the same time, hydraulic fluid is introduced into the piston ends of both the piston and cylinder devices 56, 57. As a result, this spacing between the two cutting heads at 10 and 11 is increased so that the cutting unit adopts the configuration illustrated in FIG. 2. The width of the driveway 5 is therefore increased as the mining machine is withdrawn, thus increasing the amount of material excavated from the driveway. Any falls of material from the roof of the driveway which may occur due to the increased width of the driveway do so only in the part of the driveway in front of the mining machine so that the push rods and mining machine do not become fouled.

I claim:

1. A mining machine comprising two cutting units each including a rotatable cutting head having cutting faces directed forwardly and rearwardly with respect to the direction of movement of the machine and an elongated housing incorporating a drive mechanism for the cutting head extending along the axis of rotation of the cutting head the cutting units being mounted side-by-side with the cutting heads adjacent each other, each housing being movable about a vertical axis towards the end of the housing remote from the cutting head and about a transverse horizontal axis between the vertical axis and the cutting head, means for moving the cutting units about the said axes, the housings of said two cutting units being mounted on a common horizontal slideway, and said slideway defining the transverse horizontal axis about which said cutting units may be pivoted.

2. A mining machine according to claim 1 wherein each cutting head is at least equal in diameter to the vertical height of the remainder of the machine.

3. A mining machine according to claim 3 wherein the slideway comprises a tube coaxial with the horizontal axis and the means for moving the housing about the respective vertical axes comprises two pistons reciprocable under hydraulic pressure in a cylinder defined within the tube, each piston being connected to a respective one of the housings.

4. A mining machine according to claim 3 wherein each housing is connected to a respective sleeve slidably mounted on the tube and movable by a respective one of the pistons.

5. A mining machine according to claim 3 wherein the pistons are reciprocable in a common chamber in the cylinder.

6. A mining machine according to claim 3 wherein the means for moving the cutting units about their respective vertical axes further comprises hydraulic piston and cylinder devices arranged to counteract torque applied by the pistons.

7. A mining machine according to claim 1 further including upper and lower cusp cutters for excavating uncut material from between the two cutting heads.

8. A mining machine according to claim 7 wherein the lower cusp cutter comprises a mat of cutting chains entrained about a transverse horizontal axis.

9. A mining machine according to claim 7 wherein the lower cusp cutter also includes two cutting drums mounted on opposite sides of the mat of cutting chains and arranged to rotate about the transverse horizontal axis.

10. A mining machine according to claim 1 wherein each cutting unit is movable about the transverse horizontal axis by means of a respective hydraulic piston and cylinder device reciprocable along the vertical axis about which the cutting unit is movable.

* * * * *